United States Patent [19]

Ciccotelli

[11] Patent Number: 4,895,537

[45] Date of Patent: Jan. 23, 1990

[54] SWIM FIN

[76] Inventor: Stephen S. Ciccotelli, P.O. Box 1414, Deming, N. Mex. 88031

[21] Appl. No.: 302,614

[22] Filed: Jan. 27, 1989

[51] Int. Cl.[4] ..... A63B 31/08

[52] U.S. Cl. ..... 441/64

[58] Field of Search ..... 441/60–64

[56] References Cited

U.S. PATENT DOCUMENTS

| | | | |
|---|---|---|---|
| 3,032,787 | 5/1962 | Mazzella | 441/64 |
| 4,689,029 | 8/1987 | Ciccotelli | 441/64 |
| 4,738,645 | 4/1988 | Garofalo | 441/64 |
| 4,775,343 | 10/1988 | Lamont | 441/64 |

*Primary Examiner*—Joseph F. Peters Jr

*Assistant Examiner*—Jesus D. Sotelo

*Attorney, Agent, or Firm*—William J. Ruano

[57] ABSTRACT

The swim fin has a rigid blade that is fixedly attached to the end portions of two flexible beams which are molded to the sides of the foot pocket and project therefrom. The flexible beams project forwardly and inwardly for a short distance so as to position the flexible beams behind the toe of the foot pocket as the swim fin moves through the water during swimming. The height of the flexible beams is reduced at a position near the leading edge of the rigid blade so that most of the flexing is confined to this position. The rigid blade is hollow and the end portions of the flexible beams are enclosed in the shell of the rigid blade.

4 Claims, 1 Drawing Sheet

SWIM FIN

This invention relates to improvements in a swim fin and comprising an improvement over U.S. Pat. Ser. No. 4,773,885.

BACKGROUND OF THE INVENTION

This swim fin relates to the type of swim fin in which a rigid blade is spaced from the foot pocket and is fixedly attached to the end portions of two flexible beams which project from the foot pocket.

In the swim fin of prior U.S. Pat. Ser. No. 4,773,885 the flexible beams project forwardly from the sides of the foot pocket and the overall distance across the flexible beams is greater than the width of the foot pocket. This configuration results in reduced efficiency because both the flexible beams and the foot pocket disturb the water before the rigid blade as the swim fin moves through the water.

SUMMARY OF THE INVENTION

It is an object of this invention to provide a swim fin in which more area of the rigid blade acts on undisturbed water by positioning the part of the flexible beams that project from the foot pocket so that the flexible beams are behind the foot pocket as the swim fin moves through the water during swimming.

In the swim fin of prior patent U.S. Pat. Ser. No. 4,773,885 the configuration of the flexible beams when viewed from the side is similar to that of conventional swim fin, but in a swim fin having a rigid blade spaced from the foot pocket, the efficiency of the swim fin can be substantially improved by reducing the height of the flexible beams at a position before the rigid blade.

It is an object of this invention to provide a swim fin in which the height of the flexible beams is reduced at a position near the leading edge of the rigid blade thereby giving the rigid blade a hinge-like action.

In the swim fin of prior U.S.Pat. 4,773,885, the end portions of the flexible beams are clamped to a flat rigid blade and the end portions of the flexible beams generate drag as the swim fin moves through the water.

It is an object of this invention to provide a rigid hollow blade in which the end portions of the flexible beams are enclosed in the shell of the rigid blade.

It is a further object of this invention to eliminate warpage of the foot pocket by providing a swim fin with a foot pocket composed of the same grade of thermoplastic elastomer as that of the flexible beams and by molding a plurality of straps in the part of the foot pocket that fits over the arch of the foot as in prior U.S. Pat. Ser. No. 4,778,423.

It is another object of the present invention to provide a swim fin which will increase the swimmer's speed and range.

Further objects and advantages of my invention will appear as the specification proceeds.

DETAILED DESCRIPTION OF THE DRAWINGS

The foot pocket 1 has two flexible beams 2 molded to the sides of the foot pocket 1 and projecting therefrom, and as in prior U.S. Pat. No. 4,778,423 the flexible beams and the foot pocket are molded in one piece of the same grade of thermoplastic elastomer and the part of the foot pocket that fits over the arch of the foot is molded to include a plurality of straps 1A to provide flexibility at this part of the foot pocket 1.

The flexible beams 2 project forwardly and inwardly for a short distance so that the flexible beams 2 are positioned in front of the toe of the foot pocket 1 and the overall distance across the end portions 2A of the flexible beams 2 is substantially less than the maximum width of the foot pocket 1.

This configuration has the added advantage of streamlining the toe area of the foot pocket 1. The end portions 2A of the flexible beams 2 are enclosed in a hollow rigid blade 3 and secured with fasteners 4.

Figure 1:
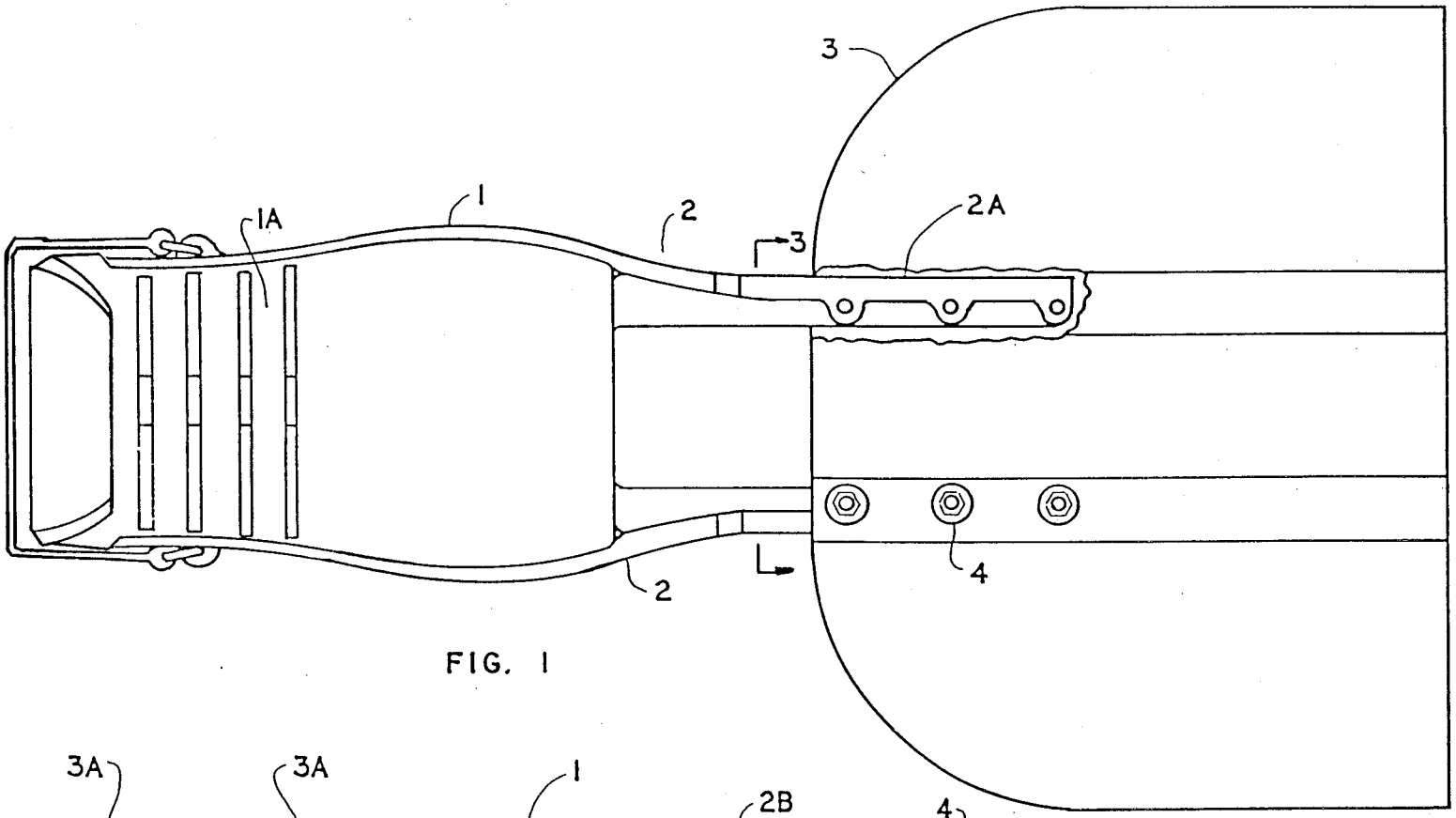
FIG. 1 is a top view of the swim fin.
Figure 3:
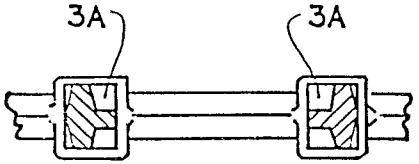
FIG. 3 is a sectional view taken through the flexible beams at 3—3 of FIG. 1.

The rigid blade 3 has two openings 3A illustrated in FIG. 3 at the leading edge through which the end portions 2A of the flexible beams 2 are inserted into the shell of the rigid blade 3. In FIG. 1 part of the wall of the rigid blade 3 is broken away to expose the end portion 2A of one of the flexible beams 2.

Figure 2:
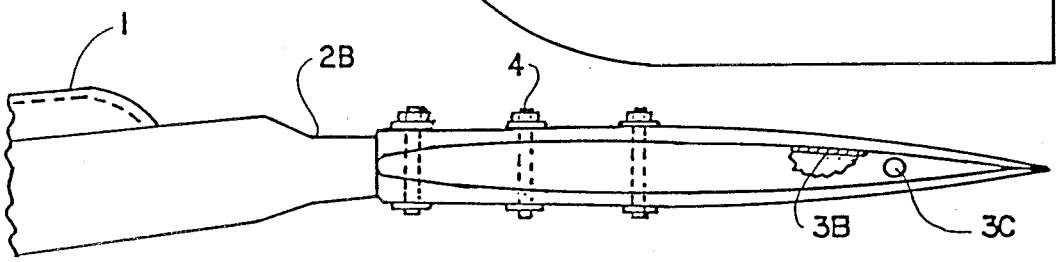
FIG. 2 is a partial side view of FIG. 1.

In FIG. 2 part of the wall of the rigid blade 3 is broken away to show the wall thickness 3B of the hollow rigid blade 3. A drain hole 3C in the side of the rigid blade 3 is also illustrated.

In FIG. 2, the height of the flexible beams 2 is shown reduced at a position 2B before the leading edge of the rigid blade 3. The purpose of this is to confine most of the flexing of the flexible beams 2 to this position thereby giving the rigid blade 3 a hinge like action. The degree to which the height of the flexible beams 2 is reduced is important to the efficient operation of the swim fin. If the flexible beams 2 are uniformly tapered as in the conventional swim fin, the swim fin of the present invention performs like a conventional swim fin, but when the height of the flexible beams 2 is reduced as illustrated in FIG. 2 the efficiency, thrust and speed of the swim fin are increased.

While I have illustrated and described a single specific embodiment of my invention, it will be understood that this is by way of illustration only and that various changes and modifications may be contemplated in my invention within the scope of the following claims.

I claim:

1. In a swim fin: (a) a foot pocket; (b) two flexible beams molded to the sides of the foot pocket and projecting forwardly and inwardly for a short distance so that the flexible beams are behind the foot pocket as the swim fin moves through the water during swimming: (c) a rigid blade spaced from the foot pocket;and (d) means to secure the rigid blade to the end portions of the flexible beams.

2. In the swim fin of claim 1, wherein: the height of the flexible beams is reduced at a position near the leading edge of the rigid blade to confine most of the flexing to this position, thereby giving the rigid blade a hinge action.

3. In the swim fin of claim 1, wherein: the rigid blade is molded as a hollow shell with two openings at the leading edge for inserting into the shell of the rigid blade the end portions of the flexible beams.

4. In the swim fin of claim 1, wherein: (a) the foot pocket and the flexible beams are molded of the same grade of thermoplastic elastomer, and (b) the part of the foot pocket that fits over the arch of the foot includes a plurality of straps to provide flexibility at this part of the foot pocket.

* * * * *